US009033125B2

(12) United States Patent
Herold

(10) Patent No.: US 9,033,125 B2
(45) Date of Patent: May 19, 2015

(54) APPARATUS AND METHOD FOR SELF-STABILIZING ROLLABLE LUGGAGE ASSEMBLY

(75) Inventor: Jeffrey Herold, Huntington Beach, CA (US)

(73) Assignee: West Coast Trends, Inc., Huntington Beach, CA (US)

( * ) Notice: Subject to any disclaimer, the term of this patent is extended or adjusted under 35 U.S.C. 154(b) by 571 days.

(21) Appl. No.: 12/408,649

(22) Filed: Mar. 20, 2009

(65) Prior Publication Data

US 2010/0236886 A1 Sep. 23, 2010

(51) Int. Cl.

| | |
|---|---|
| ***A45C 3/00*** | (2006.01) |
| ***A45C 7/00*** | (2006.01) |
| *A45C 5/14* | (2006.01) |
| *A45C 13/00* | (2006.01) |

(52) U.S. Cl.

CPC ..... *A45C 7/0045* (2013.01); *A45C 5/14* (2013.01); *A45C 13/001* (2013.01)

(58) Field of Classification Search

USPC ..... 190/18 A, 108

See application file for complete search history.

(56) References Cited

U.S. PATENT DOCUMENTS

| | | | | | |
|---|---|---|---|---|---|
| 1,396,270 | A | * | 11/1921 | Grierson | 224/150 |
| 3,257,051 | A | * | 6/1966 | Browning | 224/572 |
| 4,478,429 | A | * | 10/1984 | Adams | 280/655 |
| 4,558,896 | A | * | 12/1985 | Farnworth | 294/156 |
| D282,787 | S | * | 2/1986 | Nichols | D34/25 |
| 4,576,664 | A | * | 3/1986 | Delahunty | 156/71 |
| 4,672,725 | A | * | 6/1987 | Kasai | 24/625 |
| 4,759,431 | A | * | 7/1988 | King et al. | 190/18 A |
| 4,817,835 | A | * | 4/1989 | Tarr, Jr. | 224/150 |
| 4,860,408 | A | * | 8/1989 | Johnson | 24/68 CD |
| 4,911,271 | A | * | 3/1990 | Stanley | 190/102 |
| 5,501,308 | A | | 3/1996 | King | |
| 5,671,832 | A | * | 9/1997 | London et al. | 190/108 |
| 5,673,464 | A | * | 10/1997 | Whittaker | 24/301 |
| 5,829,559 | A | | 11/1998 | Nordstrom et al. | |
| 5,852,849 | A | * | 12/1998 | Lansing et al. | 24/3.4 |
| 6,112,963 | A | * | 9/2000 | Pratt | 224/250 |
| 6,353,982 | B1 | * | 3/2002 | Looker et al. | 24/302 |
| 6,611,995 | B2 | * | 9/2003 | Jackson et al. | 24/298 |
| 2006/0102672 | A1 | * | 5/2006 | Godshaw | 224/572 |
| 2008/0111330 | A1 | * | 5/2008 | Lurie | 280/35 |
| 2008/0116029 | A1 | * | 5/2008 | Kita et al. | 192/85 A |
| 2008/0190721 | A1 | * | 8/2008 | Burton | 190/103 |
| 2009/0139813 | A1 | * | 6/2009 | Francis | 190/18 A |
| 2010/0155187 | A1 | * | 6/2010 | Godshaw et al. | 190/102 |

FOREIGN PATENT DOCUMENTS

| | | | |
|---|---|---|---|
| JP | 03-036006 | U9 | 1/1997 |
| WO | 93-39891 | A1 | 12/1996 |

OTHER PUBLICATIONS

International Search Report and Written Opinion dated Aug. 13, 2010.

* cited by examiner

*Primary Examiner* — Tri Mai
(74) *Attorney, Agent, or Firm* — Donn K. Harms

(57) ABSTRACT

An apparatus and method for forming a self-stabilized luggage assembly is disclosed. In one embodiment the method includes coupling a first piece of luggage in contact with a second piece of luggage using an adjustable stabilizer configured to couple a handle on the first piece of luggage to a handle on the second piece of luggage while wheels on the bottom of the first and second pieces of luggage remain on the ground when the first and second pieces of luggage are tilted, upright, moving, and stationary. Other embodiments are described and claimed.

11 Claims, 8 Drawing Sheets

APPARATUS AND METHOD FOR SELF-STABILIZING ROLLABLE LUGGAGE ASSEMBLY

BACKGROUND

Some conventional pieces of luggage, such as carry-on suitcases and rolling duffel bags, may have rollers on the bottom to make the bags easier for travelers to transport. However, travelers often need to transport two or more wheeled pieces of luggage simultaneously. If a traveler needs to transport two wheeled pieces of luggage, both hands are typically required. Consequently, while transporting two or more large, heavy pieces of luggage, the traveler may find it difficult or impossible to do other things, such as answering a cellular telephone call, retrieving cash or keys from a pocket or purse, holding the hand of a small child, etc.

Furthermore, in many situations, travelers find it difficult to maneuver multiple pieces of luggage simultaneously. For instance, it can be difficult to safely transport two large pieces up or down a step or escalator, or to transport both pieces through a narrow opening. Such maneuvers may be particularly difficult when the traveler is small and one or both of the pieces of luggage are large and heavy. When more than two pieces need to be transported, these kinds of difficulties may be multiplied.

BRIEF DESCRIPTION OF THE DRAWINGS

Features and advantages of the present invention will become apparent from the appended claims, the following detailed description of one or more example embodiments, and the corresponding figures, in which:

DETAILED DESCRIPTION

Figure 1:
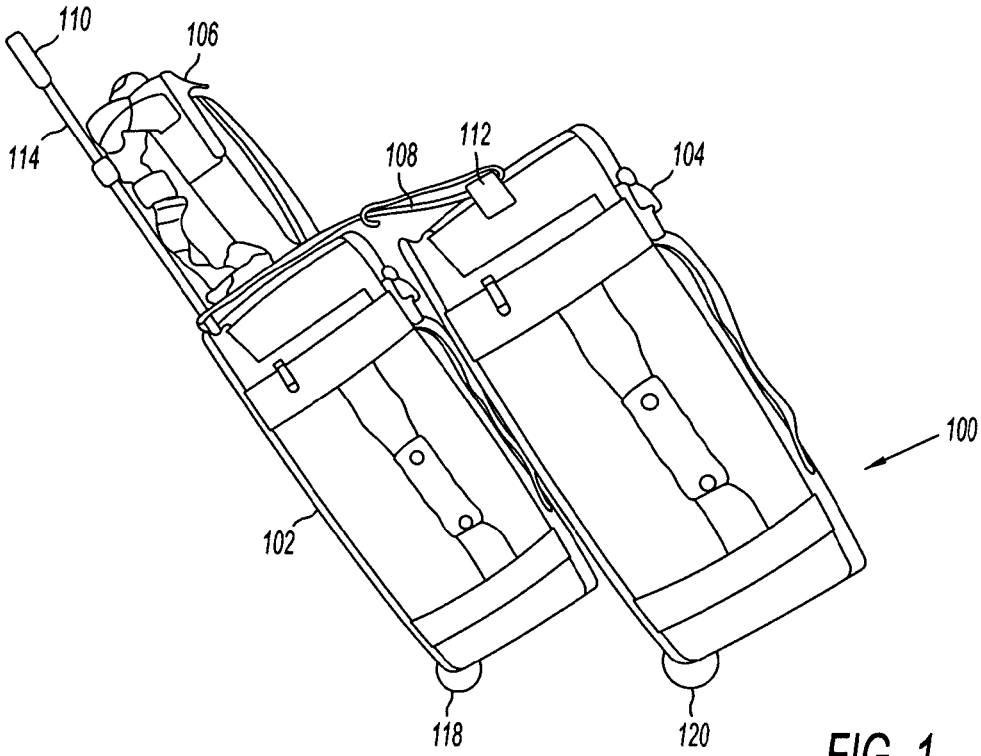
FIG. 1 depicts an embodiment of a tilted luggage assembly including two suitcases and a shoulder bag.
Figure 2:
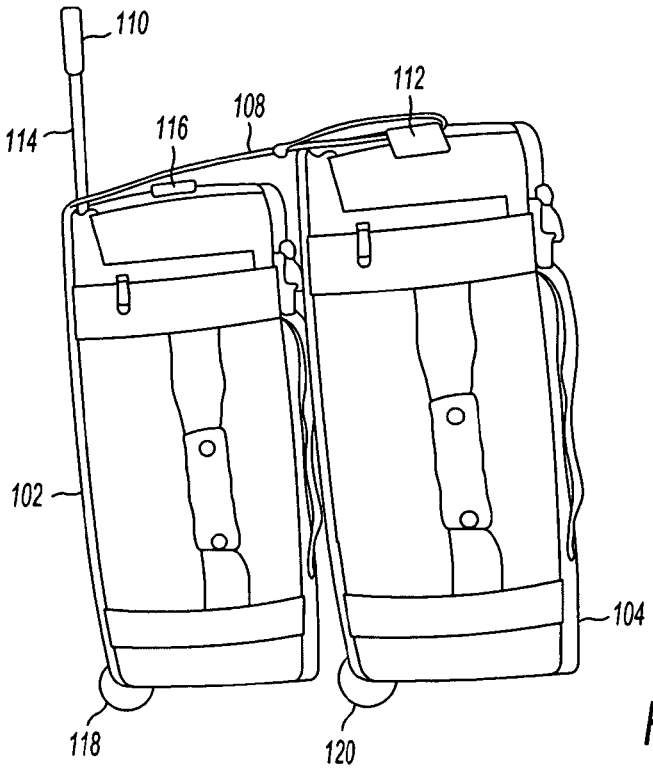
FIG. 2 depicts an embodiment of the luggage assembly in an upright position.

FIGS. 1 and 2 depict an example embodiment of a luggage assembly 100 including carry-on suitcase 102 connected to trailing suitcase 104, and shoulder bag 106. Moreover, suitcases 102 and 104 are connected with stabilizer 108 in a way that allows all or most of the weight of assembly 100 to rest on the wheels of carry-on suitcase 102 and trailing suitcase 104. Stabilizer 108 enables assembly 100 to be self-stabilized when in motion and when stationary, and in particular, a traveler does not need to hold handle 110 for assembly 100 to remain in an inclined position as shown in FIG. 1 or upright as shown in FIG. 2, whether assembly 100 is in motion or stationary. These and other characteristics of luggage assembly 100 provide for excellent stability and maneuverability. Additional details concerning the components and steps used for creating rollable luggage assembly 100, as well as various operating characteristics of stabilizer 108 and luggage assembly 100, are provided below.

Figure 3A:
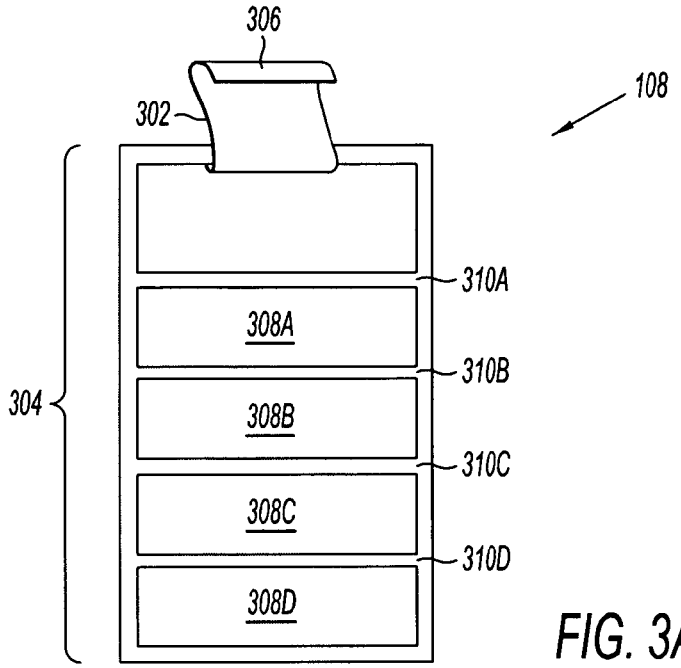
FIG. 3A shows a top view of an embodiment of a stabilizer that can be used in the luggage assemblies of FIGS. 1 and 2.

Referring to FIGS. 1 and 3A, FIG. 3A shows an embodiment of stabilizer 108 including a first connector or attachment member 302 configured to fit under a handle 112 on a first suitcase. Handle 112 is typically sized to accommodate a person's hand and the attachment member 302 can be further configured to be at least half as wide as the length of the handle 112 to increase the stability of suitcase 104 when coupled to suitcase 102 with stabilizer 108. Stabilizer 108 also includes extension portion 304 (also referred to as a central body) coupled to the attachment member 302. The length of extension portion 304 can be configured to extend between the first suitcase 102 and second suitcase 104 and to retain the first suitcase 102 adjacent to the second suitcase 104 when the first and second suitcases 102, 104 are upright, tilted, moving, and stationary.

Extension portion 304 can include one or more engagement structures such as slots 308A-308D along the length of extension portion 304. The embodiment of stabilizer 108 shown in FIG. 3A includes four (4) rectangular slots 308A-308D within extension portion 304, however any suitable number and shape of slots 308A-308D can be used. Once attachment member 302 is pulled under and through handle 112, the end of extension portion 304 coupled to attachment member 302 can be folded over handle 112 to couple or engage attachment member 302 to one of slots 308.

Attachment member 302 can include an end 306 that is L-shaped, cotter-pin shaped, U-shaped, or another suitable shape to fit under handle 112 on the first suitcase 104 and engage one of slots 308. As shown in FIGS. 1 and 2, attachment member 302 can include a substantially planar portion between end 306 and extension portion 304 to allow attachment member 302 to fit between handle 112 and suitcase 104. Other suitable configurations of attachment member 302 can be used such as velcro, snaps, and/or one or more straps, among others.

Extension portion 304 can have any other suitable dimensions and shape. Extension portion 304 is typically fabricated using an inelastic material, although the material can be rigid/semi-rigid, or flexible for easy storage. The material can also be elastic with a low modulus of elasticity. For example, in some embodiments, extension portion 304 is fabricated with ballistic nylon and attachment member 302 is fabricated with metal or plastic. In other embodiments, extension portion 304 is fabricated with plastic. Additionally, the edges of slots 308 can be reinforced with a rigid material such as plastic or metal to increase the stability of luggage assembly 100. Other suitable materials and configurations can be used for extension portion 304 and attachment member 302.

In one embodiment, extension portion 304 is approximately 16 inches long and 8 inches wide. Slots 308 are approximately 2.5 inches long by 7.5 inches wide with one-half to one inch dividers or edges 310 between slots 308. Attachment member is approximately 2.5 inches long and 2 inches wide. Other suitable dimensions can be used based on the size of handles 110, 112 on suitcases 102, 104.

Figure 3B:
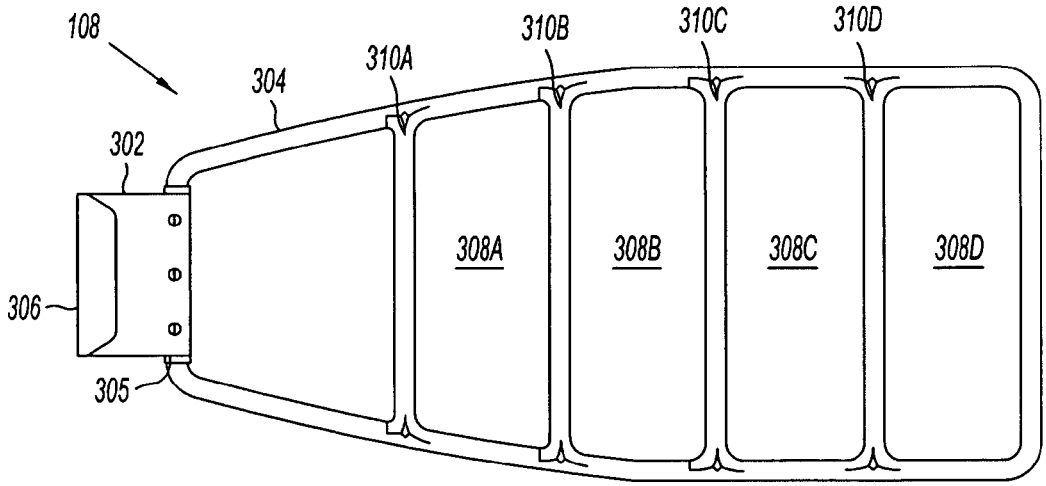
FIGS. 3B and 3C show respective top and side views of another embodiment of a stabilizer that can be used in the luggage assemblies of FIGS. 1 and 2.
Figure 3C:
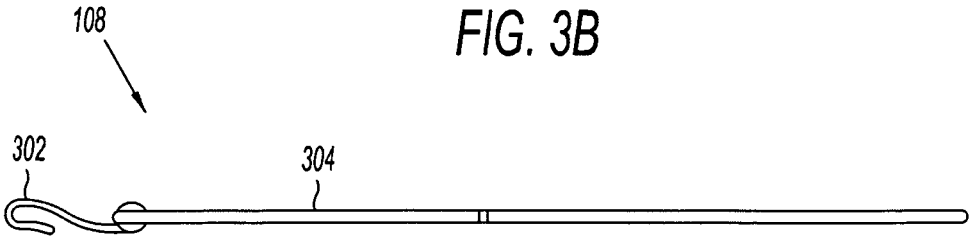
Figure 4:
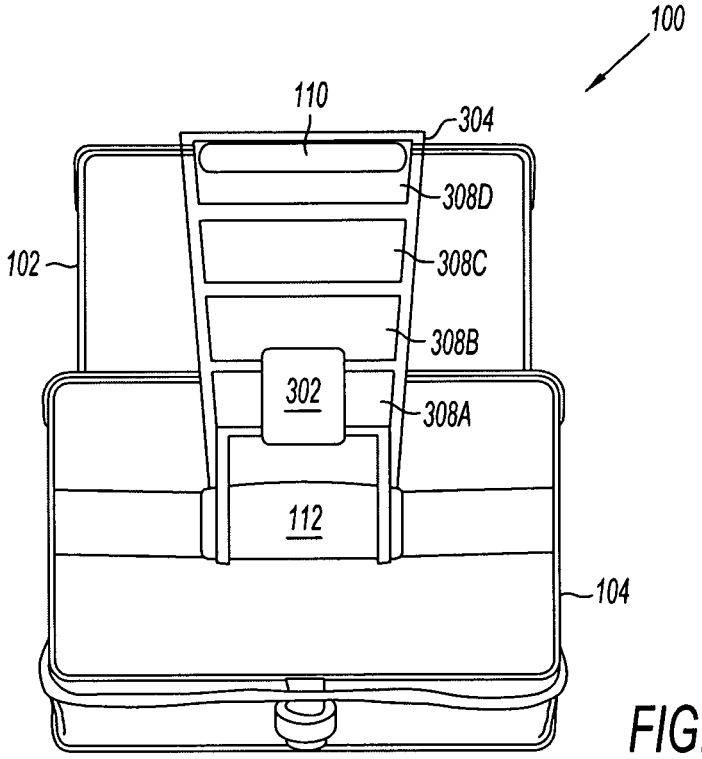
FIG. 4 shows a top view of the stabilizer of FIG. 3A coupling a pair of suitcases.

FIGS. 3B and 3C show respective top and side views of another embodiment of stabilizer 108 including a first connector or attachment member 302 configured to fit under a handle 112 (FIG. 1) on a suitcase. Handle 112 is typically sized to accommodate a person's hand and the attachment member 302 can be any suitable size. In some embodiments, attachment member 302 is configured to be at least half as wide as the length of the handle 112 to increase the stability of suitcase 104 when coupled to suitcase 102 with stabilizer 108. Stabilizer 108 also includes an extension portion 304 (also referred to as a central body) coupled to the attachment member 302. The length of extension portion 304 can be configured to extend between the first suitcase 102 and second suitcase 104 and to retain the first suitcase 102 adjacent to the second suitcase 104 when the first and second suitcases 102, 104 are upright, tilted, moving, and stationary. Extension portion 304 is tapered at one end to be slightly larger than the width of attachment member 302 where one end of attachment member 302 is fastened to extension portion 304. In the embodiment shown, one end 305 of attachment member 302 wraps around the end of the tapered section of extension portion 304 and is fastened to extension portion 304 with rivets. Other suitable fasteners and configurations for coupling or fastening attachment member 302 to extension portion 304 can be used.

The other end 306 of attachment member 302 can be L-shaped, cotter-pin shaped, U-shaped, or another suitable shape to fit under handle 112 on the first suitcase 104 and engage an edge of one of dividers 310A-D between slots 308A-D. As shown in FIGS. 1 and 2, attachment member 302 can include a substantially planar portion between end 306 and extension portion 304 to allow attachment member 302 to fit between handle 112 and suitcase 104. Other suitable configurations of attachment member 302 can be used such as velcro, snaps, and/or one or more straps, among others.

Extension portion 304 can include one or more engagement structures such as slots 308A-308D along the length of extension portion 304. The embodiment of stabilizer 108 shown in FIG. 3B includes a combination of one trapezoidal slot 308A and three (3) rectangular slots 308B-308D in extension portion 304, however any suitable number and shape of slots 308A-308D can be used. Extension portion 304 can also have any other suitable dimensions and shape. Extension portion 304 is typically fabricated using an inelastic material, although the material can be rigid/semi-rigid, or flexible for easy storage. The material can also be elastic with a low modulus of elasticity. For example, in some embodiments, extension portion 304 is fabricated with ballistic nylon and attachment member 302 is fabricated with metal or plastic. In other embodiments, extension portion 304 is fabricated with plastic. Additionally, the edges of slots 308 can be reinforced with a rigid material such as plastic or metal to increase the stability of luggage assembly 100. Other suitable materials and configurations can be used for extension portion 304 and attachment member 302.

In one embodiment, extension portion 304 is approximately 16 inches long and 8 inches wide at one end, and tapers from 8 inches at divider 308B to approximately 2.5 to 3 inches at the end of extension portion 304 that is couple to attachment member 302. Slots 308B-308D are approximately 2.5 inches long by 7 inches wide, and slot 308A has a trapezoidal shape that is approximately 2.5 inches long and tapers from approximately 7 inches wide at divider 308B to 6 inches at divider 308A. Another tapered slot 312 can be included between divider 310A and the end of extension portion 304 at attachment member 302. Dividers 310 can be one-half to one inch wide. In some embodiments, attachment member 302 is approximately 2.5 inches long and 2 inches wide. Other suitable dimensions can be used for extension member 304, attachment member 302, slots 308, and dividers 310 based on the size of handles 110, 112 on suitcases 102, 104.

Referring to FIGS. 3A-3C and 4, FIG. 4 shows a top view of stabilizer 108 coupling suitcases 102, 104 to one another. One of slots 308A-308D in stabilizer 108 will typically be the correct distance to engage handle 110 on the second suitcase 102 while extension portion 304 (also referred to as a central body) is folded over handle 112 and attachment member 302 is engaged in one of slots 308. In the example shown in FIG. 4, slot 308D engages handle 110 on suitcase 102 while attachment member 302 engages slot 308B. The slot 308A-308D used will generally depend on the depth of suitcases 102 and 104 and the dimensions of slots 308. For example, thin suitcases 102, 104 may result in attachment member 302 engaging slot 308C or 308D while deep suitcases 102, 104 may result in attachment member 302 engaging slot 308A or 308B. In general, a slot 308 that positions suitcases 102, 104 in contact with, or with minimum possible separation from, one another while in upright and tilted positions, and while in motion and stationary, and while wheels 118, 120 on suitcases 102, 104 remain on the ground, is typically used. Wheels 118, 120 can be swivel wheels, unidirectional wheels, or other suitable devices that allow suitcases 102, 104 to roll along.

The handle 110 on the second suitcase 102 is typically sized to accommodate a person's hand and can include a retractable portion 114 that allows handle 110 to be stored within or along the backside of suitcase 102 and approximately flush with the top of suitcase 102. Handle 110 may be placed in a stored position and raised after the appropriate slot 308 has been positioned over handle 110.

Figure 5:
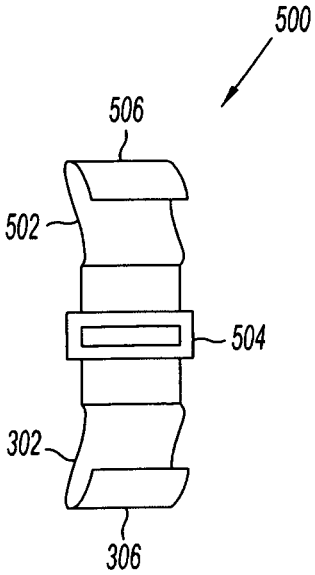
FIG. 5 shows another embodiment of a stabilizer.
Figure 6:
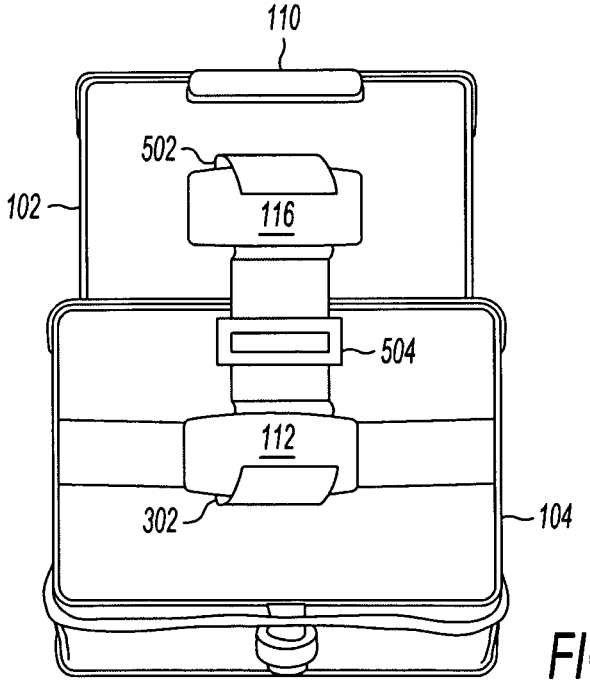
FIG. 6 shows a top view of the stabilizer of FIG. 5 coupling a pair of suitcases.

Referring to FIGS. 5 and 6, another embodiment of a stabilizer 500 is shown including a first connector or attachment member 302 engaged in handle 112 on suitcase 104 and a second attachment member 502 engaged in handle 116 on suitcase 102. Handles 112, 116 are typically sized to accommodate a person's hand and the attachment members 302, 502 can be further configured to engage at least half of the length of the handles 112, 116 to increase the stability of suitcase 104 when coupled to suitcase 102 with stabilizer 500. Stabilizer 500 can also include an adjustable extension portion 504 coupled between attachment members 302, 502. The extension portion 504 includes two lengths of material coupled with a buckle or other suitable fastener. Stabilizer 500 is configured to extend between suitcases 102, 104 and to retain suitcase 102 adjacent to suitcase 104 when suitcases 102, 104 are upright, tilted, moving, and stationary.

Attachment member 502 can include an end 506 that is L-shaped, U-shaped, cotter-pin shaped, or that has another suitable-shape to engage at least an edge of handle 112 or 116. As shown in FIG. 6, attachment members 302, 502 can include a substantially planar portion between ends 306, 506 and extension portion 504 to allow attachment members 302, 502 to fit under handles 112, 116 on respective suitcases 102, 104. Other suitable configurations of attachment member 302, 502 can be used, such as velcro, snaps, and/or one or more straps, among others. Although the embodiment of extension portion 504 shown has a rectangular shape, extension portion 504 can have any suitable shape, such as an oval, square, or circle.

Figure 7:
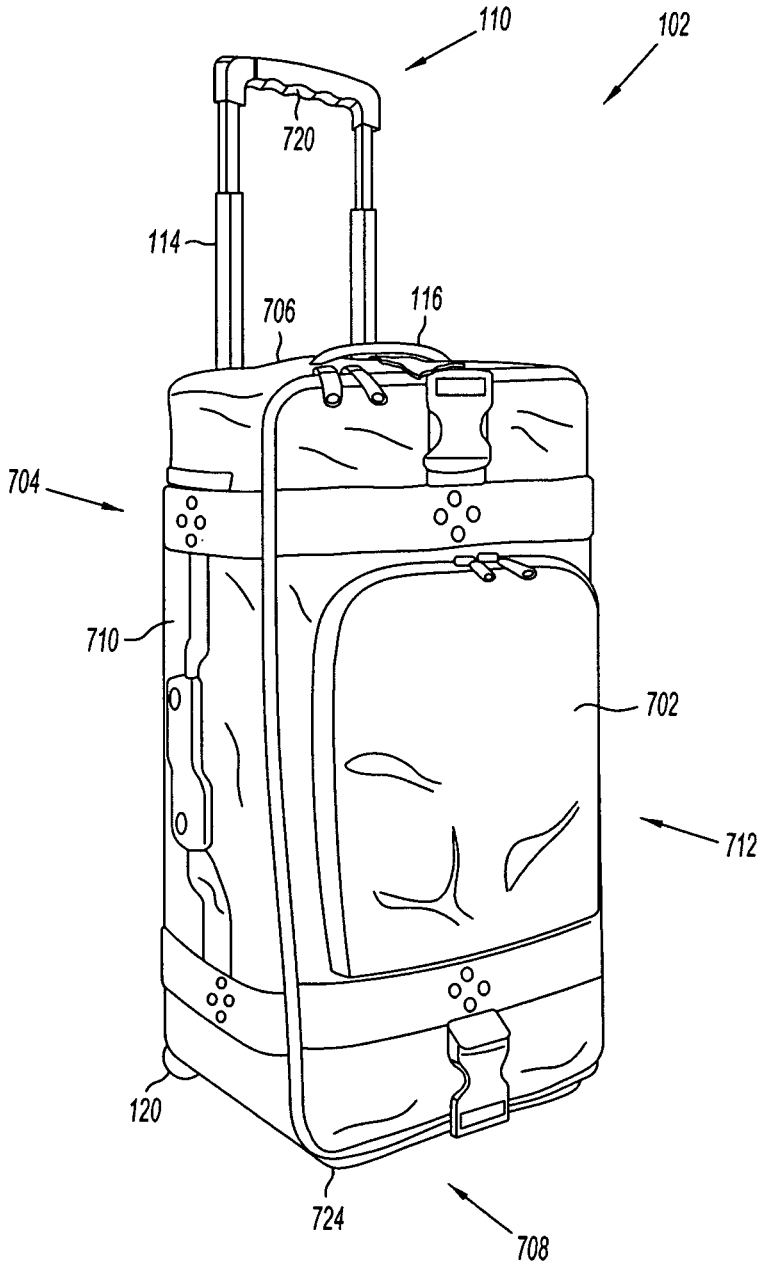
FIG. 7 depicts a perspective view of an embodiment of a piece of luggage referred to as a carry-on suitcase.

FIG. 7 depicts a perspective view of an embodiment of a piece of luggage referred to as a carry-on suitcase 102. As illustrated, carry-on suitcase 102 has a front 702, a back 704, a top 706, a bottom 708, a left side 710, and a right side 712. As described in greater detail below, in some embodiments, two or more suitcases 102, 104 (FIG. 1) are coupled with stabilizer 108 to form a luggage assembly 100 that can easily be transported, maneuvered, and parked. For purposes of this disclosure, suitcases 102, 104 may be referred to as a suitcase or a piece of luggage.

In the embodiment of FIG. 7, the top of suitcase 102 features a soft handle 116. Left side 710 can also features a soft handle. First suitcase 102 also features a substantially rigid, yet extendable handle 110 that includes two extendable, rigid upright members 114, and a substantially rigid grip member 720 that spans the top of upright members 114. In the embodiment of FIG. 1, handle 110 is situated at the back of suitcase 102, and is centered longitudinally between the left and right sides. In other embodiments, handle 110 is attached to a single, rigid retractable upright member 114 instead of two retractable upright members 114.

Suitcase 102 can also have a pair of rigid or swivel wheels 120, with one wheel situated at the back left corner of the bottom of the suitcase 102, and the other wheel situated at the back right corner of the bottom of the suitcase 102. One or more feet 724 may also be provided at or near the front edge of the bottom of suitcase 102, to provide stability and prevent movement when suitcase 102 is parked in an upright position with the weight resting on feet 724 and wheels 120. Alternatively, swivel wheels can be provided at the back and front of a suitcase.

To balance luggage assembly 100, suitcase 104 is typically the same size, larger, and/or weighs equal to or more than suitcase 102. Stabilizer 108 can be adjusted as required to balance luggage assembly 100 in upright and tilted positions with wheels 118, 120 of both suitcases 102, 104 remaining on the ground. If stabilizer 108 is too tight, the wheels 120 of suitcase 104 may lift off the ground and cause luggage assembly 100 to become unstable. If stabilizer 108 is too loose, it can be difficult to balance suitcases 102, 104 so that luggage assembly 100 is self-stabilized. Stabilizer 108 provides a wide range of adjustment to establish a center of gravity for various sizes and weights of suitcases that balances those suitcases in inclined and upright positions.

FIGS. 8-11 depict side views of luggage pieces 102, 104 and an embodiment of a method for creating luggage assembly 100 (FIG. 1). Note that instructions according to embodiments of a method for creating luggage assembly 100 can be included in packaging with the stabilizer 108 or available via another source, such as a sign displayed where stabilizers 108 are sold, and/or a manufacturer's website that may be accessed via a computerized information network, such as the Internet.

Figure 8:
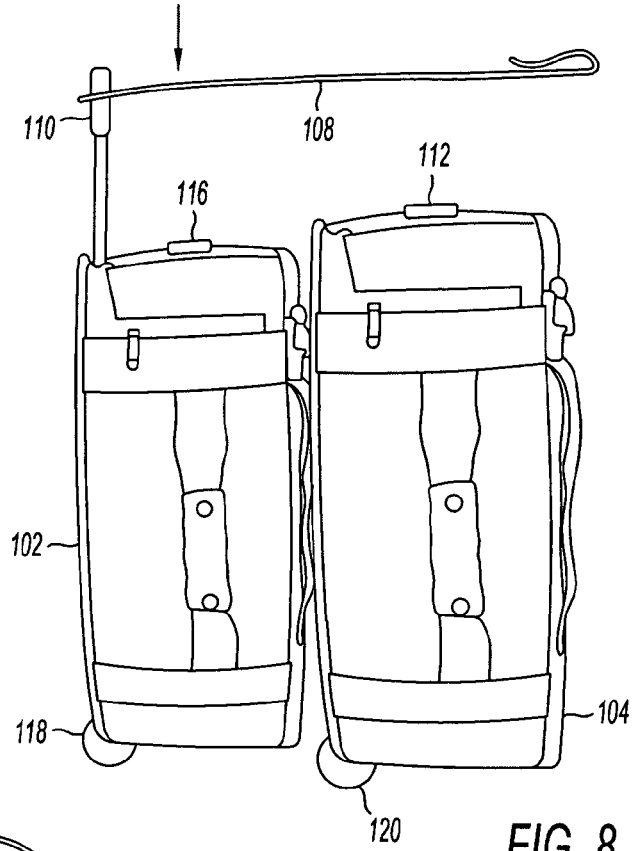
FIGS. 8-11 depict an embodiment of a method for creating the luggage assembly of FIG. 1.

FIG. 8 depicts first suitcase 102 and second suitcase 104 resting upright on the floor, as they might be situated, for instance, after a traveler has retrieved second suitcase 104 from a baggage carousel. The process for attaching the suitcases together in a manner to create a stable luggage assembly 100 may begin with the suitcases 102, 104 in this position. The back of suitcase 104 is placed adjacent to the front of suitcase 102. One of slots 308 (FIG. 3A) of stabilizer 108 is placed over the retractable handle 110 of suitcase 102.

Figure 9:
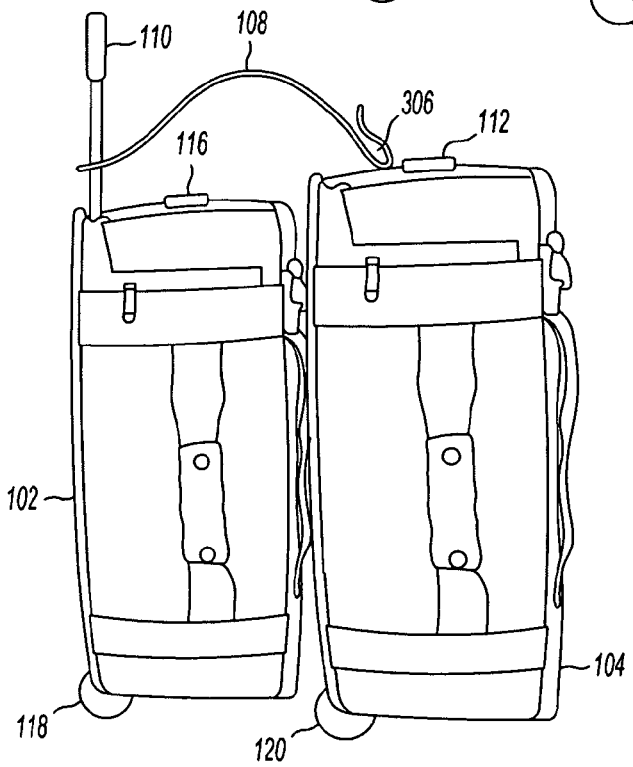
Figure 10:
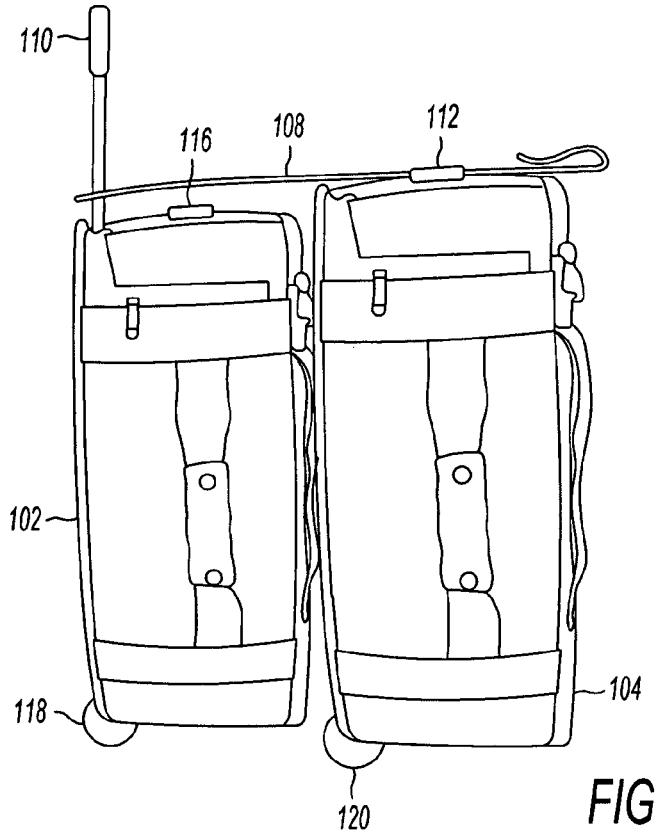
Figure 11:
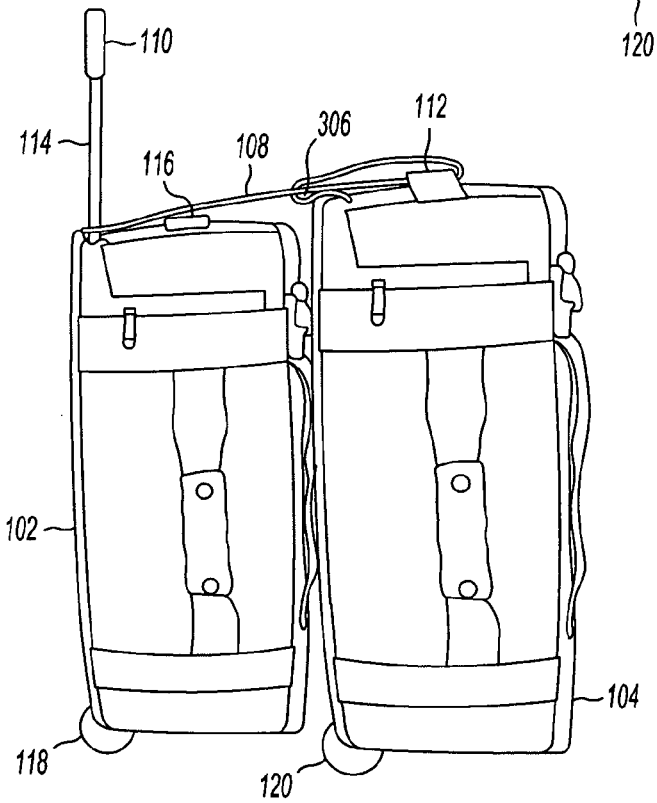

FIG. 9 shows the loose end 306 (FIG. 3A) of stabilizer 108 ready to be pulled through under handle 112 on suitcase 104, thus engaging handle 112 on top of suitcase 104. FIG. 10 shows stabilizer 108 being pulled taut through handle 112, and FIG. 11 shows stabilizer 108 being folded over handle 112 so that end 306 (FIG. 3A) of attachment member 302 can engage an edge of one of slots 308.

In other embodiments, the traveler can engage handle 110 on top of the first piece of luggage 104 with one end 306 (FIG. 6) of the stabilizer 500 (FIG. 6) and engage handle 116 on top of the second piece of luggage 102 with another end 506 of the stabilizer 500.

When one of slots 308 engages handle 110, or handle 116 engages attachment member 502 (FIG. 5), first suitcase 102 may be in an upright position and second suitcase 104 may lean against first suitcase 102. In this configuration, most of the weight of second suitcase 104 may rest behind wheels 120. The force of gravity may therefore pull stabilizer 108, 500 firmly against the handles 112, and 110 or 116.

Stabilizers 108, 500 are configured to retain second suitcase 104 in contact with at least a portion of first suitcase 102, and prevent second suitcase 104 from sliding down or moving away from the front of first suitcase 102 while luggage assembly 100 is in motion. In some embodiments, stabilizer 108, 500 keeps the top back edge of second suitcase 104 substantially adjacent to the top back edge of first suitcase 102. In other embodiments, stabilizer 108, 500 may allow the second suitcase 104 to slide a short distance further down the back of the first suitcase 102. However, it is generally preferable to keep to top of the second suitcase 104 within a certain distance, such as, for example, approximately two to four inches within the top of the first suitcase 102, to provide weight distribution advantages such as those described below.

When first suitcase 102 and second suitcase 104 are tilted or inclined as shown in FIG. 1, most of the weight of second suitcase 104 sits behind wheels 120. Consequently, the weight of second suitcase 104 keeps second suitcase 104 firmly pressed against first suitcase 102, and prevents second suitcase 104 from accidentally reverting to the upright position. Furthermore, a sufficient portion of the weight of the assembly 100 typically rests behind wheels 120 to prevent suitcase 102 from reverting to the upright position. As described in greater detail below, this tendency for the suitcases to stay in inclined or tilted positions may be referred to as internal pitch stability or self-stabilizing.

Accordingly, when the suitcases 102, 104 are substantially fully loaded and are configured in the position depicted in FIG. 1, luggage assembly 100 tends to remain in that position, with some of the weight of the assembly supported by wheels 118 on suitcase 102, and the rest supported by wheels 120 on suitcase 104. Consequently, once the assembly 100 has been completed, the traveler need not expend any effort to keep the assembly together and properly positioned. The traveler may also easily move assembly 100 with a single hand. Furthermore, whether stationary or in motion, and whether tilted or not, the assembly 100 is completely self-stabilized and may continue on its established course while in motion with no hands or other external support.

In addition, in some embodiments, when in the completed and ready-to-roll position depicted in FIG. 1, much of the weight of assembly 100 can rest behind wheels 120. For instance, depending upon the weight of each suitcase, and the distribution of weight in each suitcase, approximately twenty to forty percent of the weight of the assembly 100 might rest behind wheels 120 of the suitcase 104.

Furthermore, handle 110 provides significant leverage, and stabilizer 108, 500 prevents second suitcase 104 from shifting from its position on first suitcase 102. Consequently, it is typically easy to press down on handle 110 and lift wheels 120 completely off of the ground. For example, if the weight is well distributed within the suitcases, it may be easy for a 110 pound traveler to perform this operation with one hand on a luggage assembly 100 weighing in excess of 100 pounds. Additionally, the further down the traveler pushes handle 110, the more weight shifts behind wheels 120. The traveler may therefore easily balance the whole assembly 100 on wheels 118 similar to maneuvering baby strollers over steps, escalators, etc. Accordingly, with the assembly 100 balanced on the wheels 118 of the leading suitcase 102, the traveler may find it very easy to maneuver the entire assembly 100 around turns, over steps, up and down escalators, and through various other obstacles which would be more difficult to handle with two or more pieces of conventional luggage, one in each hand. Further, since assembly 100 is no wider than the widest suitcase in the assembly 100, it may be easy to maneuver assembly 100 through crowded or narrow openings or passages. Alternatively, when suitcases 102, 104 include swivel wheels, no downward pressure may be required to maneuver luggage assembly 100 in tight spaces.

When the traveler does not want assembly 100 to move, the traveler may simply return first suitcase 102 to the upright position, so that feet 724 contact the ground and bear some of the weight of assembly 100.

Also, as indicated above, the way stabilizer 108, 500 connects the first and second suitcases together helps to keep the left and right sides of second suitcase 104 from lifting or moving away from first suitcase 102 when assembly 100 is in the rollable configuration. In other words, stabilizer 108, 500 prevents second suitcase 104 from spinning or rotating along its longitudinal axis, relative to first suitcase 102. For example, in the embodiment of FIG. 8, stabilizer 108, 500 prevents second suitcase 104 from rolling more than five degrees, relative to first suitcase 102, when first suitcase 102 and second suitcase 104 are substantially fully packed. Another embodiment may allow the first suitcase to roll up to thirty degrees, relative to the first suitcase. This type of stability for assembly 100 may be referred to as internal roll stability. By contrast, the resistance of the entire assembly 100 from rotating about its longitudinal axis may be determined largely by the distance between the wheels on the bottom of first suitcase 102, and that type of stability may be referred to as external roll stability.

Assembly 100 also exhibits good internal and external pitch stability. For purposes of this disclosure, internal pitch stability refers to the tendency of both suitcases 102, 104 to retain the same angle of inclination, relative to each other, when the first and second suitcases 102, 104 are in the rollable configuration. In other words, the attachment members, the weight distribution, and other features work to resist forces which might otherwise cause one suitcase to lean up or down, relative to the other suitcase, even when a traveler is not holding onto handle 110 or any other part of the first suitcase 102 or second suitcase 104. Good internal pitch stability is one of the attributes that makes it easy to lift wheels 120 by pressing down on handle 110. External pitch stability refers to the tendency of the complete assembly 100 to keep wheels 118, 120 on the ground.

Furthermore, assembly 100 exhibits good internal and external yaw stability. For purposes of this disclosure, internal yaw stability refers to the tendency for the first and second suitcases 102, 104 to keep the same relative alignment for their longitudinal axes. In other words, considering the contact are between the first and second suitcases 102, 104, the back of the second suitcase 104 tends not to rotate relative to the front 702 of the first suitcase 102. External yaw stability refers to the tendency for assembly 100 to track straight when it is rolling on all four wheels. The characteristics of pitch, roll, and yaw stability exhibited by assembly 100 contribute to assembly 100 being self-stabilized when in motion and when stationary, whether suitcases 102, 104 are tilted or not.

Figure 12:
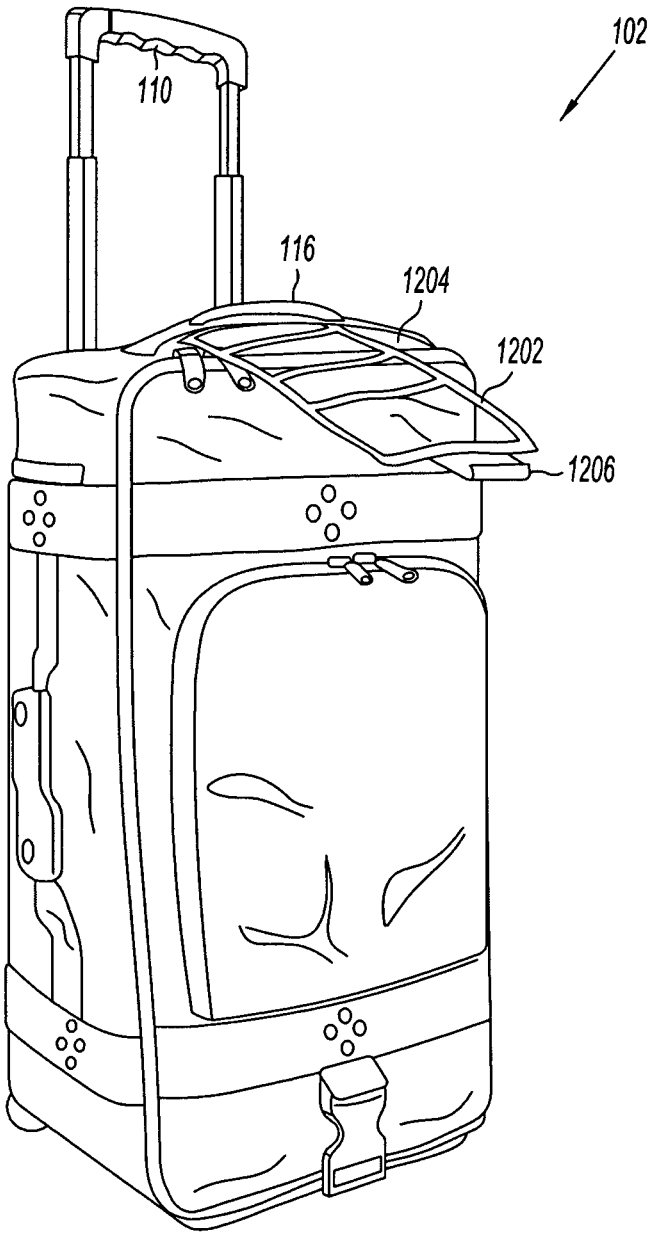
FIG. 12 is an embodiment of a stabilizer built into or stored in a pocket of a suitcase.

Referring to FIG. 12, another embodiment of stabilizer 1202 is shown built into a pocket 1204 at the top of suitcase 102. One end of stabilizer 1202 can be sewn or otherwise fastened into pocket 1204 while another end 1206 is available to couple to another suitcase (not shown). Stabilizer 1202 can be stored in pocket 1204 when not in use. In other embodiments, stabilizer 1202 may be completely removable from pocket 1204, and one end (not shown) of stabilizer 1202 may be configured to be attached to handle 110, 116 or other suitable location on suitcase 102, while another end 1206 of stabilizer 1202 is attached to a suitable location on another suitcase (not shown).

Figure 13:
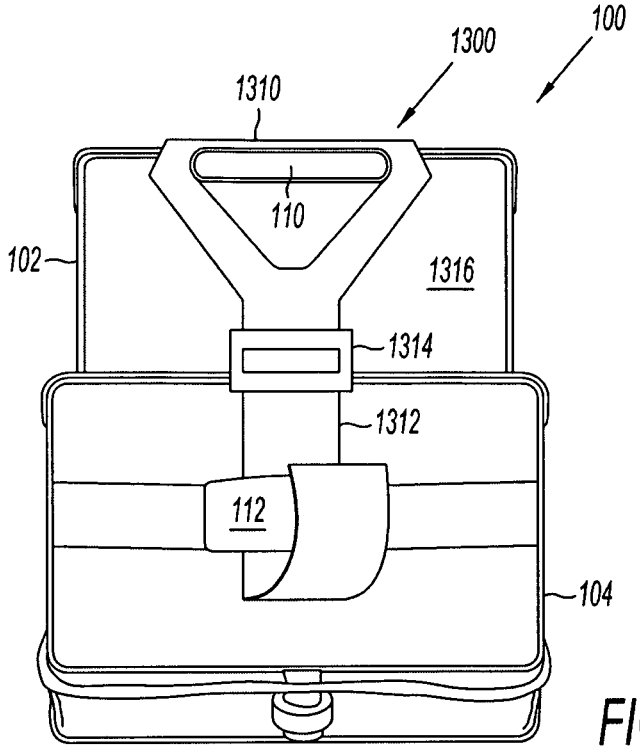
FIG. 13 shows another embodiment of a stabilizer for a luggage assembly.

FIG. 13 shows another embodiment of a Y-shaped stabilizer 1300 that can be used to form luggage assembly 100 (FIG. 1). One attachment member 1310 of stabilizer 1300 includes a triangular opening with a base that is positioned around upright supports of retractable handle 110. Another section 1312 of stabilizer 1300 extends over the top of suitcases 102, 104 and includes an end that is configured to engage at least a portion of handle 112. Stabilizer 1300 can also include an adjustable extension portion 1314 coupled between attachment members 1310, 1312 using a buckle or other suitable fastener. Stabilizer 1300 is configured to extend between suitcases 102, 104 and to retain suitcase 102 adjacent to suitcase 104 when suitcases 102, 104 are upright, tilted, moving, and stationary. Extension portion 1314 can be configured to allow a traveler to pull excess material from between handles 110, 112 and draw suitcases 102, 104 closer together, as well as to extend the length of extension portion 1314 as required.

Figure 14:
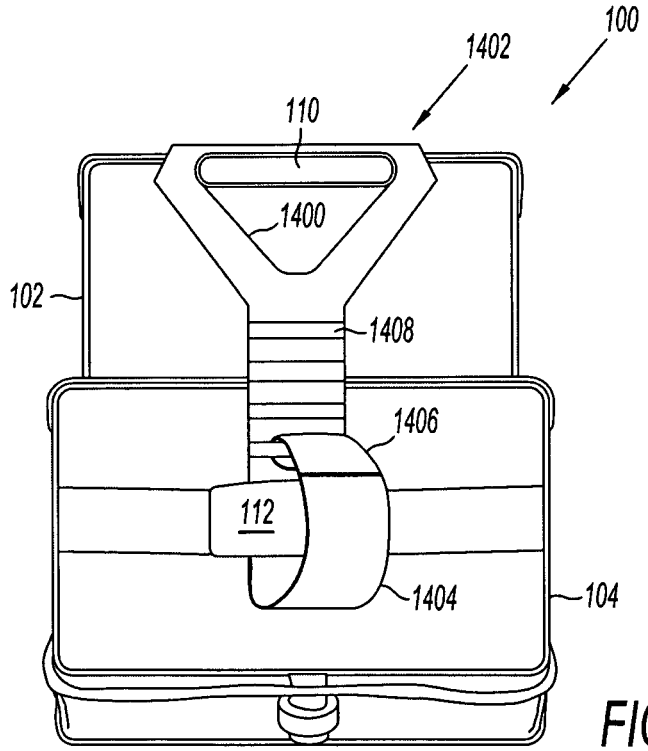
FIG. 14 shows another embodiment of a stabilizer for a luggage assembly.

FIG. 14 shows another embodiment of a Y-shaped stabilizer 1400 that can be used to form luggage assembly 100. One section 1402 of stabilizer 1400 is positioned around upright supports of retractable handle 110 and another section 1404 of stabilizer 1400 extends over the top of suitcase 104 and includes an end 1406 that is configured to wrap around handle 112 and engage one of a series of slots or bars 1408 positioned on a central or extension portion of stabilizer 1400 between handles 110 and 112. Stabilizer 1400 is configured to extend between suitcases 102, 104 and to retain suitcase 102 adjacent to suitcase 104 when suitcases 102, 104 are upright, tilted, moving, and stationary. The traveler can engage end portion 1406 in one of slots or bars 1408 to pull excess material from between handles 110, 112 and draw suitcases 102, 104 closer together.

Thus, as has been described, embodiments of a rollable luggage assembly 100 may be made of two or more luggage pieces using suitable attachment means to keep the luggage assembly self-stabilized when stationary and when rolling. The size and weight of each luggage piece, when fully loaded, as well as the configuration of the attachment means, may serve to keep the pieces balanced on the wheels of the assembly, In light of the principles and example embodiments described and illustrated herein, it will be recognized that the illustrated embodiments can be modified in arrangement and detail without departing from such principles. For instance, alternative embodiments may use approaches like those described above to create luggage assemblies with other types and sizes of suitcases, other types of attachment members, etc. Also, second trailing suitcase may be attached to the first trailing suitcase to form a rolling luggage assembly with six wheels on the ground. Likewise, more than two trailing suitcases could be balanced in a luggage assembly in inclined and upright positions.

Also, the foregoing discussion has focused on particular embodiments, but other configurations are contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments.

Similarly, although example processes have been described with regard to particular operations performed in a particular sequence, numerous modifications could be applied to those processes to derive numerous alternative embodiments of the present invention. For example, alternative embodiments may include processes that use fewer than all of the disclosed operations, processes that use additional operations, and processes in which the individual operations disclosed herein are combined, subdivided, rearranged, or otherwise altered.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims and all equivalents to such implementations.

What is claimed is:

1. A luggage coupling apparatus for coupling a first suitcase pulled by a user to a trailing adjacent second suitcase, comprising:

an attachment member having a first side in an engagement to a first end of an extension portion, said attachment member having a U-shaped distal end opposite said first side;

said extension portion having opposing sides extending from said first end thereof, to a second end;

said extension portion in a configuration for a communication across a space above a first suitcase and second suitcase adjacent thereto, said first end of said extension portion having a trapezoidal shaped first slot formed therein extending from a narrow portion of said first slot adjacent said first end of said extension portion, to a wider portion of said first slot terminating at a first divider extending between said opposing sides;

a tapered portion of said extension portion adjacent said first end thereof, said tapered portion defined by a narrower spacing between said two opposing sidewalls adjacent said first end of said extension portion to a wider spacing between said opposing sides adjacent said first divider;

said tapered portion configured for communication of a portion thereof through an area between a handle engaged with said second suitcase, and said suitcase;

said tapered portion of said extension portion being sufficiently flexible to curve around said handle on the second suitcase in a wrap around engagement thereto extending back toward said first suitcase;

a plurality of additional rectangular slots formed between said opposing sidewalls of said extension portion, said plurality of additional rectangular slots positioned in-between said first divider and said second end of said extension portion, and having respective secondary dividers therebetween;

one of said rectangular-shaped slots positioned on said extension portion engageable to a first engagement with an elongated handle extending above a top surface of said first suitcase;

said U-shaped distal end of said attachment member while in said wrap around engagement, and with a said rectangular slot in a said first engagement, configured for a removable engagement with said first divider or one of said respective secondary dividers, to form an engagement configuration of said extension portion;

the engagement configuration of the extension portion extending substantially a fixed distance between the handle of the second suitcase and the first engagement of the extension portion with said first suitcase;

said engagement configuration providing for adjusting said fixed distance for maintaining the first suitcase in a contact with, and adjacent to and substantially aligned with the second suitcase, with their respective wheels continually remaining on said support surface and providing for a support of their respective weights thereon.

2. The luggage coupling apparatus of claim 1 additionally comprising:

said attachment member having a width, said extension portion having a width at said first end, said width of said attachment member being substantially the same as said width of said extension portion at said first end.

3. The luggage coupling apparatus of claim 2 additionally comprising:

said attachment member having a substantially planar portion extending between said first side thereof to said distal end thereof; and said planar portion allowing for an easy passage of said attachment member through an area between said handle of said second suitcase and said second suitcase to achieve said wrap around engagement.

4. The luggage coupling apparatus of claim 3 additionally comprising:

said plurality of additional rectangular slots numbering 4.

5. The luggage coupling apparatus of claim 4 additionally comprising:

said luggage coupling formed of inelastic material.

6. The luggage coupling apparatus of claim 3 additionally comprising:

said luggage coupling formed of inelastic material.

7. The luggage coupling apparatus of claim 2 additionally comprising:

said plurality of additional rectangular slots numbering 4.

8. The luggage coupling apparatus of claim 2 additionally comprising:

said luggage coupling formed of inelastic material.

9. The luggage coupling apparatus of claim 1 additionally comprising:

said attachment member having a substantially planar portion extending between said first side thereof to said distal end thereof; and said planar portion allowing for an easy passage of said attachment member through an area between said handle of said second suitcase and said second suitcase to achieve said wrap around engagement.

10. The luggage coupling apparatus of claim 9 additionally comprising:

said plurality of additional rectangular slots numbering 4.

11. The luggage coupling apparatus of claim 1 additionally comprising:

said plurality of additional rectangular slots numbering 4.

* * * * *